US005284454A

United States Patent [19]

Randolph

[11] Patent Number: 5,284,454

[45] Date of Patent: Feb. 8, 1994

[54] TOY HELICOPTER

[76] Inventor: George B. Randolph, 8553 Sleepy Hollow, Warren, Ohio 44484

[21] Appl. No.: 932,716

[22] Filed: Aug. 20, 1992

[51] Int. Cl.[5] ..... A63H 27/01; A63H 27/28; A63H 27/133

[52] U.S. Cl. ..... 446/45; 446/36; 446/62; 446/64; 446/67

[58] Field of Search ..... 446/34, 36, 37, 38, 446/39, 40, 44, 45, 61, 62, 63, 64, 65, 66, 67

[56] References Cited

U.S. PATENT DOCUMENTS

| | | | |
|---|---|---|---|
| 2,667,352 | 1/1954 | Sepersky | 446/45 |
| 2,746,207 | 5/1956 | Starkey | 446/45 |
| 2,899,773 | 8/1959 | Lockwood | 446/34 |
| 3,119,196 | 1/1964 | Alberico et al. | 446/34 |
| 3,390,480 | 7/1968 | Turner | 446/45 |
| 3,803,752 | 4/1974 | Vanni | 446/45 |
| 4,863,413 | 9/1989 | Schwarz | 446/34 |

FOREIGN PATENT DOCUMENTS

| | | | |
|---|---|---|---|
| 0833895 | 5/1960 | United Kingdom | 446/45 |

*Primary Examiner*—Robert A. Hafer
*Assistant Examiner*—Gregory M. Stone
*Attorney, Agent, or Firm*—Don Berquist

[57] ABSTRACT

A toy helicopter device is disclosed which is capable of a projected nose up ascent and a helicopter nose down descent. The device has a streamlined two dimensional main body comprising a nose, stem, and tail portion. The tail portion is hingedly connected to two helicopter blades arranged adjacent and partially overlapping each other. Resilient means located in the gap between the tail and helicopter blades can be adjusted to control helicopter blade deployment early or late during the catapult projection. At a selected rotational velocity from the catapult, the spinning toy helicopter deploys the helicopter blades to approximately right angles to the main body and the device continues to rotate slowly to the ground. The launch angle relative to the ground is not significant in determining a successful deployment.

2 Claims, 3 Drawing Sheets

TOY HELICOPTER

BACKGROUND

1. Field of Invention

This invention relates to toys, more particularly to a toy helicopter adapted to be forcibly propelled into the air, and further adapted, at or before reaching its point of highest possible ascent to invert itself and rotate with its blades outspread during its return to the ground. Uniquely the present invention device requires no releaseable hold mechanism to assist in the deployment of the helicopter blades at the high point of its trajectory.

2. Description of Prior Art

Catapulted or projected aerial toys commonly are delicate to adjust, unsafe due to high mass, easy to break or bend, and usually require a large area in which to perform. Gliding toys are usually difficult for the lay person to adjust in order for their performance to create the enjoyment of predictable flight.

Toy helicopters offer the best possibility of inexpensive predictable flight provided a reliable control system causes the helicopter blades to deploy at the most favorable moment after the launch, which is usually made from the ground.

U.S. Pat. No. 2,044,819 discloses a "projectile" utilizing three helicopter blades to cause a slow descent but the blades necessarily have a curvature to match the cylindrical shape of the bomb or mortar projectile. Also the copter blade deployment method is immediate upon exposure to the high velocity airstream as the projectile leaves the aircraft from which it must be launched.

The U.S. Pat. No. 2,746,207 is a medium mass device promising to perform very closely to the claims of the present patent, however, the design is inverted, having the outside tip of the blades before launch at the forward part of the device and requiring a releaseable hold mechanism that complicates, adds mass, and reduces streamlining. Spinning about the projected flight axis during ascent is not a necessary part of the helicopter blade deployment function, in contrast, the present invention deploys its helicopter blades partially as a result of spin during the launch part of the flight.

The article disclosed in U.S. Pat. No. 3,113,398 uses magnets and electromagnets that move in a tube as part of an intricate helicopter blade deployment mechanism, in contrast to the simple mechanism herein presented.

The projectile of U.S. Pat. No. 3,188,768 is a complicated high mass toy which consists of helicopter blades that serve as part of the elongated body of the three dimensional device.

The toy projectile in U.S. Pat. No. 3,691,674 has low mass and can ascend to a high altitude but the descent function is not as interesting as it is not required to transform into a second mode of flight and it spins about a horizontal axis instead of vertical axis as a true helicopter would. Also its rate of descent would necessarily be faster or less predictable.

U.S. Pat. No. 3,826,037 teaches a very complicated medium mass toy device using springs, latches, and delicate levers for the purpose of deployment of the helicopter blades. Axial spinning is not a necessary ingredient of its function.

The toy disclosed in U.S. Pat. No. 3,903,801 is of medium mass, partially due to the design that calls for helicopter blades to be protected from the airstream on the ascent, and the addition of a "blow-out charge" that initiates deployment of the helicopter blades for descent.

U.S. Pat. No. 4,295,290 teaches a multistage device that initiates deployment with a chemical "thrust charge".

The U.S. Pat. No. 4,913,675 is a medium mass, up ascent and up descent device (i.e., it doesn't "nose over" at the apogee of its flight) utilizing a releasable hold mechanism for helicopter blade deployment.

All the toy helicopters heretofore known suffer from at least two of the identified disadvantages below:

(a) lack of sufficient streamlining that would enable the launch of a low mass device to project it to a high enough altitude before copter deployment for the purpose of generating sufficient play value.

(b) drawings imply materials used to be of wood, or dense plastic or metal causing high mass constructions which create a safety hazard for uncontrolled flying toys. High mass devices simply weigh more and can cause more severe personal injury or property damage during a misdirected launch.

(c) due to the utilization of aforementioned construction materials, higher manufacturing costs in the form of heavier more costly equipment to cut, mold, decorate, assemble and transport the final device are incurred.

(d) cylindrical main bodies require the helicopter blades to be curved along their chord if external, otherwise they will interfere with the launch aerodynamics. Curved blades are usually more costly to manufacture than flat blades.

(e) releasable hold mechanisms on a toy of this size and scope demand delicate precise construction and adjustment. On a device that will occasionally impact an immovable object, such impact may damage the delicate release hold mechanism.

(f) lack of adjustability of the timing of copter blade deployment during launch for the purpose of using the device in a limited air space such as in a back yard.

(g) many of the prior art devices are not rugged enough to sustain many flights due to the aforesaid selection of materials for construction in contrast to the present low mass invention. The high mass of most prior art causes high angular or rotational velocity during descent, sometimes in high wind, over a hardened abrasive surface such as asphalt, resulting in rapid degradation of several important parts including blade tips and release hold mechanism.

(h) through experimentation it has been found that the angle of the axis of the main body of the device during ascent relative to the angle of the motion or vectored angle of the center of mass of the main body if not aligned (non-aligned), can cause wobble and premature deployment of helicopter blades.

OBJECTS AND ADVANTAGES

Accordingly, besides the objects and advantages of the toy helicopter described above, several other objects and advantages of the present invention are:

(a) to provide a toy of the type stated which will be so designed as to ensure that a pair of helicopter blades will be retracted into the form of a launch stabilizing fin with slight angular offset during ascent of the toy, this arrangement being effective to insure rapid, accurate, spinning moment and movement of the toy to a relatively high altitude when the toy is propelled forcibly into the air by a launch means such as a rubber band.

(b) to provide a safe design of low mass.

(c) to provide a toy helicopter as stated which will be inexpensively constructed, and will make use of relatively inexpensive materials.

(d) to provide a simple two dimensional device which has the advantage of increasing rotational drag thereby slowing rotation during ascent and descent.

(e) to provide a toy helicopter as described in which the design for holding the helicopter blades together during the high speed ascent part of the flight contributes to the high altitude of launch as well as replacing the prior art releasable hold mechanism. The helicopter blades will deploy based on sensitivity to the lower air velocity and axial spinning instead of the aforementioned delicate, releaseable hold mechanism.

(f) to provide a toy helicopter as described in e) on which the lower air velocity and axial spinning just described can be selected to effect deployment by adjustment and/or twisting a rubber band or other resilient material adjacent to one or both hinges on the toy helicopter.

(g) to provide a helicopter toy that can produce repeatable, relatively predictable flights even after many flights.

(h) to provide a helicopter toy that can produce a repeatable flight path even after launching in a non-aligned mode.

Further objects and advantages are to provide a toy helicopter which can be used easily and conveniently with an inexpensive rubber band powered stick or catapult, that can launch in a non-aligned mode as well as an aligned mode (to the projected flight path), which toy is relatively safe to launch due to its low mass, which toy will function on low force as well as high force launches, which toy can be adjusted quickly to be launched successfully at an angle from the ground less than vertical, which toy can be expected to exhibit a rate of descent of approximately 3 feet per second, and which descends in a perfectly balanced straight-line flight path to the earth after helicopter deployment after being propelled into the air by a catapult.

Still more objects and advantages will appear from the following description and drawings.

SUMMARY OF THE INVENTION

A toy helicopter device for use with a catapult that can be launched upwardly into the air and during the highest part of launch or earliest part of its decent, wing portions are deployed emulating helicopter blades rotating the device slowing down its rate of decent.

DESCRIPTION OF THE PREFERRED EMBODIMENT

Figure 1:
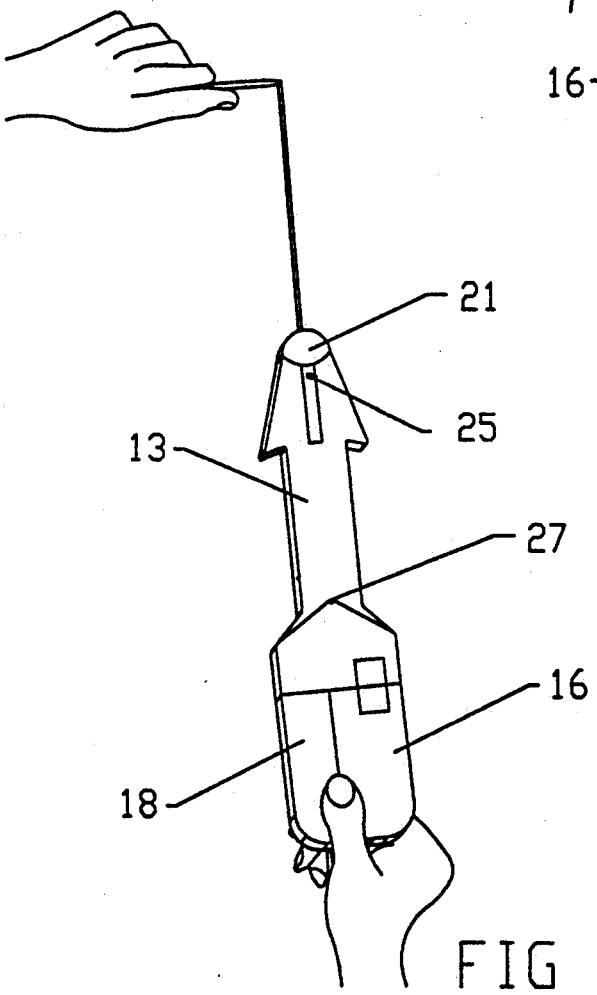
FIG. 1 is a perspective view showing the invention as it appears when in use, immediately prior to its being propelled into

Referring now to FIGS. 1-9 of the drawings, a toy helicopter can be seen having three primary parts, the main body 13 and two helicopter blades 16 and 18. In the preferred embodiment the main body is a physically strong but light weight plastic such as polystyrene closed cell foam available from Foambords Inc. of Chicago, Ill. The main body, however, can be made of any other material that is strong enough to impact the ground repeatedly without changing form or breaking such as metals, ABS plastic, polyethylene, polypropylene, PVC, vinyl, nylon, balsa wood, impregnated or laminated fibrous materials, cardboard, or paper.

The nose weight 21 is a mass approximately 3 grams usually of modelling clay or a molded rubber or soft plastic. The nose weight is attached to the H sectioned body stiffener 20 that slides into a slot in the main body and is glued or otherwise permanently attached.

Figure 4:
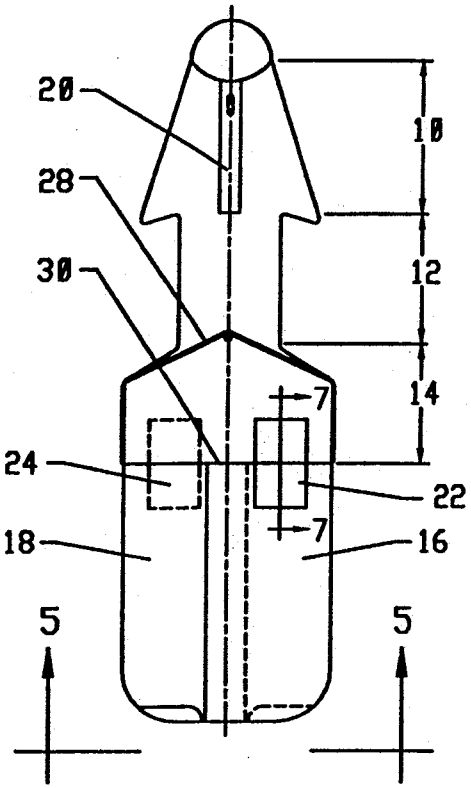
FIG. 4 is a front plan view of the invention on lines 4—4 of FIG. 3.
Figure 8:
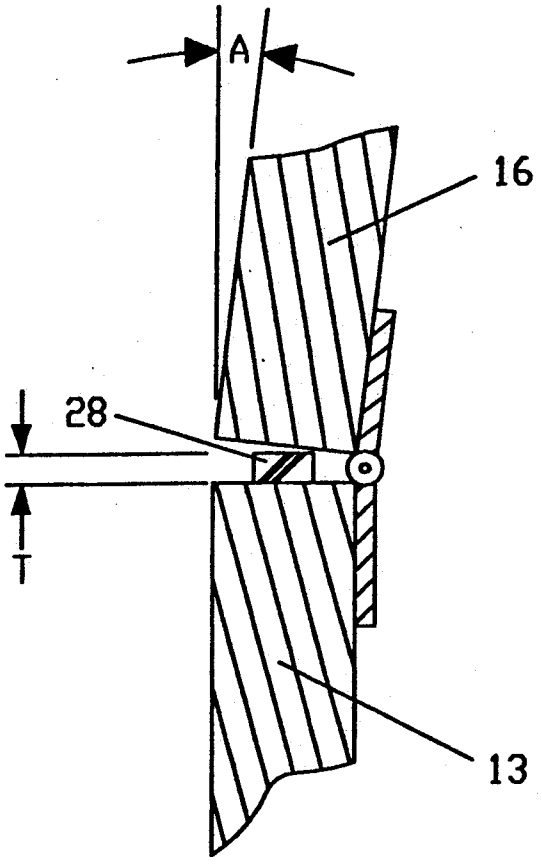
FIG. 8 is an enlarged partial cross-sectional view showing the helicopter blades of the invention in sprung position.
Figure 7:
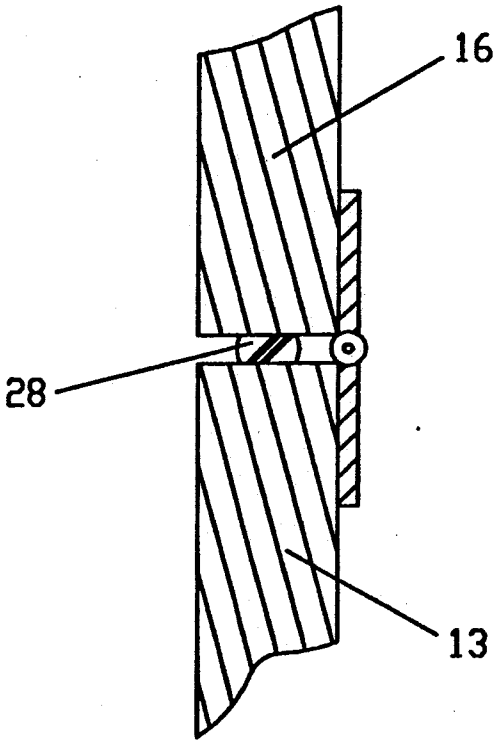
FIG. 7 is an enlarged partial cross-sectional view on line 7—7 of FIG. 4.

The main body nose portion 10 should be aerodynamically shaped as shown in FIG. 4 to assure maximum altitude from launch and sufficient rotational drag during descent. The main body stem 12 is sufficiently narrow to assure straight line projection and the tail length is sufficiently long to assure stability and to support the hinges 22 and 24. The hinges 22 and 24 are glued or otherwise attatched to the main body tail, hinge 22 to the front side and hinge 24 to the back side as illustrated in FIG. 4 and FIG. 7 and FIG. 8. The preferred hinges 22 and 24 are precision molded nylon (Dupont Zytel 101) by DU-BRO Co. of Wauconda, Ill. which offer the advantage of low friction at the steel pin joint plus long life. These hinges are preferred as they have six small holes per hinge for glue to well up into for a very reliable connection to the polystyrene. Any other hinge that flexes at least 45 degrees should also perform well.

Figure 3:
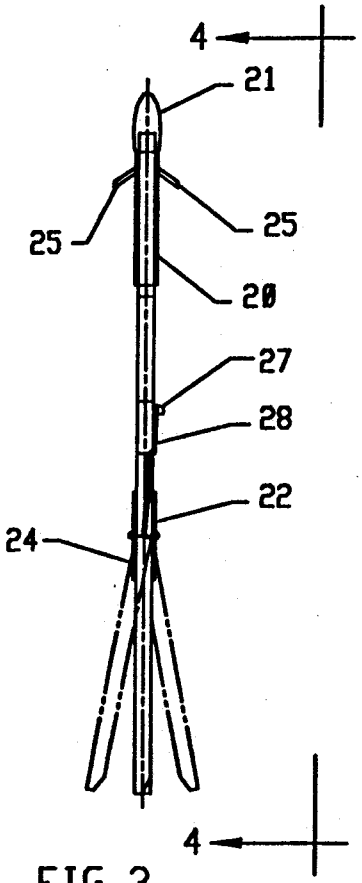
FIG. 3 is a side plan view of the invention.

The rear portion of each hinge 22 and 24 is glued or otherwise fastened securely to the wide side of the helicopter blade 16 or 18. See FIG. 7 and FIG. 8 for proper spacing of the copter blade with respect to the tail 14. A rubber band 28 is applied as shown in FIG. 3 and FIG. 4 by looping it over one of the helicopter blades and sliding it onto the tail 14 such that it lays along the tail piece on a cut plane 30 down each side of the tail 14, over peg 27 and across the stem. This routing assures sufficient surface contact to keep the rubber band 28 fixed once it has been adjusted for tautness. Other resilient means would also apply here, however, a common rubber band is easily replaceable, inexpensive and provides all the control necessary for short or long flights. Each helicopter blade 16 and 18 consists of an angled trailing edge 29 which provides stiff launch support before launch, streamlined aerodynamics during projection, and efficient wing lift during descent.

Figure 5:
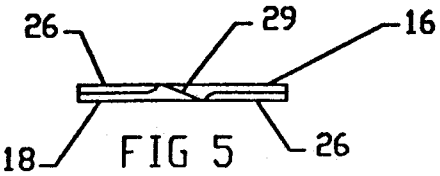
FIG. 5 is an end plan view of the invention on lines 5—5 of FIG. 4.

The tip of each helicopter blade can be beveled 26 as illustrated in FIG. 5 to assure more resolute deployment with less adjustment of the rubber band 28.

Figure 6:
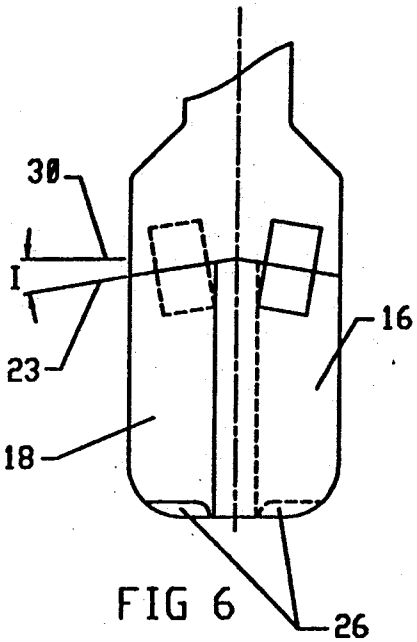
FIG. 6 is a partial front plan view of an alternate form of the invention.

An additional embodiment is shown in FIG. 6. The tail piece cut line 30 is defined as the perpendicular cut across the center line axis along the end of the tail Piece 14 adjacent to the helicopter blades. The hinge pin axis 23 intersects a line in the tail piece cut line plane, the same line of which intersects the center line axis. The angle of incidence I is the angle included between the tail piece cut line 30 and the hinge pin axis 23. As the angle I is increased, more drag will slow rotation of the helicopter blades during descent.

Figure 2:
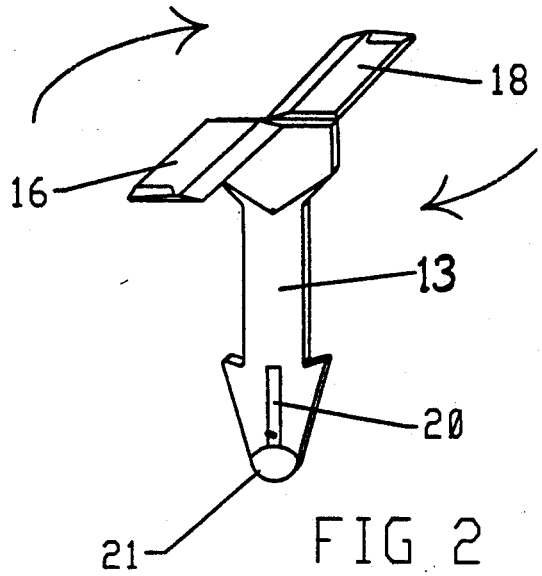
FIG. 2 is a perspective view of the invention in use during the descent thereof.

Operation—FIGS. 1, 2

The motivations for play value and method of launching the present toy helicopter is no different than much of the prior art. One end of a rubber band loop of approximately ⅛ inches by 1/32 inches x 10 inches circumference may be chosen to attach to the extreme end of a stout catapult stick of approximately 6 inches long. While holding the catapult stick in one hand at the farthest opportunity away from the attached rubber band on the other end of the stick, hold the toy helicopter in the other hand by pinching the helicopter blades together between the beveled tips 26 using thumb and index finger. Assure that the hook for launch 25 that is inserted into the free end on the Catapult Rubber Band is on the bottom on the toy helicopter in order to assure that no impact with the catapult stick will take place at the time of launch.

Hold the Catapult Stick up overhead with a stiff arm, release pressure between thumb and forefinger retaining helicopter blades 16 and 18, and observe the helicopter blades spring out due to the resilience of the rubber band 28 which is laying on the tail portion 14 adjacent to the hinges. If the distance between the blades at the tips of each helicopter blade, is approximately 15% of the length of the helicopter blade in the sprung position shown by FIGS. 8 or 9, a vertical launch will result in the deployment of the helicopter blades at or near the apogee of the launch.

Reestablish pressure between the beveled tips 26 and pull the toy helicopter stretching the catapult rubber as shown in FIG. 1. The most forgiving angle to launch that assures the deployment of the helicopter blades the first time is vertical. Catapult launch the toy helicopter by releasing pressure between the beveled tips 26 and observe it ascend to a high altitude while spinning in the direction imparted by the resilience of the rubber band 28 which springs open slightly the helicopter blades 16 and 18.

The initial high velocity of the projected toy helicopter causes two primary forces of control to act on the main body: (1) the force on the sprung opposing helicopter blades causing spinning about the center line axis, (2) the force of the beveled tips of each helicopter blade. (1) causes clockwise rotation and the other (2) causes the helicopter blade to compress the rubber band 28. In FIG. 1, the direction of rotation looking at the toy helicopter leaving you during launch would be clockwise due to the location of the hinges 22 and 24 connecting each helicopter blade 16 and 18 to the tail portion 14 of the main body. As the toy progresses upward it loses velocity resulting in an increase in angular velocity about the center line axis due to the resultant increase in the angle of the helicopter blades 16 and 18 to the plane of the center line axis. As the forces on the blades are a function of a square law, there is a large reduction in force to keep them together as the projected velocity of the toy helicopter reduces, allowing the blades to spread open to the unsprung distance shown in FIGS. 8 or 9. To assist them to open completely, the torsion induced by the beveled tips is also reducing at a nonlinear rate allowing some of the stored energy they have been imparting into the rubber band to be released by said rubber band in the form of an impulse. That in turn forces a larger angle to occur between the blades than would exist without the beveled tips. Ultimately the rotational energy of the entire toy helicopter as it projects upward through the air finally exceeds the restoring forces holding the blades back in place, allowing the moment about the hinge pins due to the mass of the blades to overcome the previous streamlining forces resulting in deployment of the copter blades 16 and 18.

Deployment of said blades results in a second mode of flight, ie., the descending mode which, similar to the prior art, is primarily one of balanced, straight line, rotating flight to the ground at an approximately constant rate of rotation and constant rate of descent in stable air.

If deployment occurs before the gravitational apogee would have occurred, a simple stretching of the rubber band 28 along the tail piece cut line (before launching) will reduce distance T and angle A of FIG. 8 thereby reducing the rotational velocity during projection which enables the toy helicopter to achieve a higher altitude before deployment on the next flight.

Figure 9:
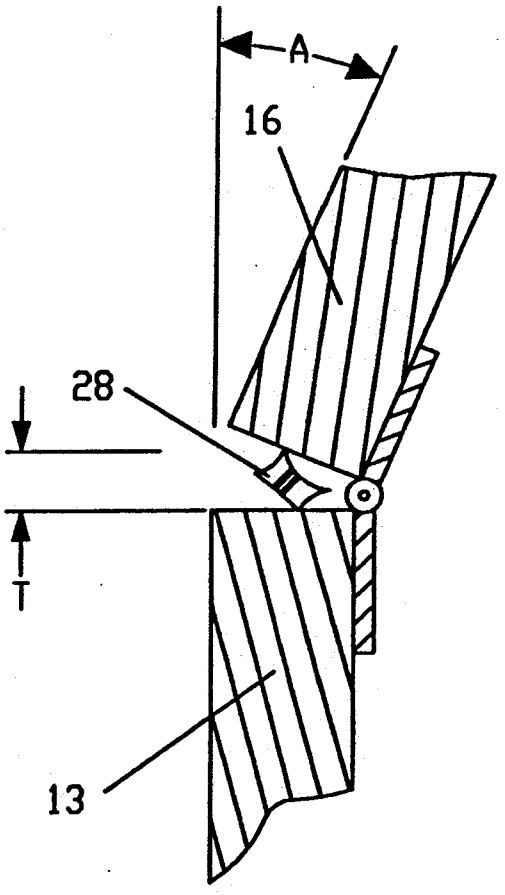
FIG. 9 is an enlarged partial cross-sectional view showing the helicopter blades in sprung position having an alternate rubber band configuration.

If deployment occurs at too high an altitude or not at all, either a reduction of tension in the rubber band 28 or, if all tension has been removed, the rubber band can be given a twist or multiple twists to increase the distance T and angle A of FIG. 9 thus increasing main body rotational velocity during projection. Increasing distance T and angle A will cause the toy helicopter to deploy at a lower altitude on the next flight.

If it is desireable to launch the toy helicopter at an angle less than 90 degrees to the ground, it may be necessary to increase the distance T and angle A per FIGS. 8 or 9 slightly to assure deployment as the minimum forward velocity experienced during the flight will be higher and the sufficiently fast rotational velocity required for deployment may not be reached. Herein is the possibility of skill development and the resultant increase in personal development play value.

Thus it will be seen that a new and novel helicopter toy has been illustrated and described and it will be apparent to those skilled in the art that various changes and modifications may be made therein without departing from the spirit of the invention.

I claim:

1. A toy helicopter device capable of a projected nose up ascent and a helicopter nose down descent comprises; an elongated generally flat main body having a top end, a weighted nose on said top end, and a hook means thereon, said nose portion contiguous at its bottom end with a narrow elongated stem portion, the bottom of said stem portion contiguous with a wider tail portion having a tail portion cut plane, the tail portion of which a front side is hingedly connected to a right hand helicopter blade, and a back side is hingedly connected to a left hand helicopter blade, both said blades of which are symmetrical and adjacent to each other, both of said blades are offset symmetrically about a center line axis of said main body and both of said blades having trailing edges, angles and outer tips, a compressible resilient means between each helicopter blade and said tail portion on the tail cut plane, said compressible resilient means may be dimensionally adjustable in thickness by various means including stretching, tension releasing and twisting said resilient means.

2. The device of claim 1 wherein a bevel is formed at the outer tip of each helicopter blade on the side opposite the hinge for each of said helicopter blade.

* * * * *